US009328619B2

(12) United States Patent
Chouhan

(10) Patent No.: US 9,328,619 B2
(45) Date of Patent: May 3, 2016

(54) BLADE HAVING A HOLLOW PART SPAN SHROUD

(71) Applicant: General Electric Company, Schenectady, NY (US)

(72) Inventor: Rohit Chouhan, Bangalore (IN)

(73) Assignee: General Electric Company, Schenectady, NY (US)

( * ) Notice: Subject to any disclaimer, the term of this patent is extended or adjusted under 35 U.S.C. 154(b) by 620 days.

(21) Appl. No.: 13/662,891

(22) Filed: Oct. 29, 2012

(65) Prior Publication Data

US 2014/0119923 A1 May 1, 2014

(51) Int. Cl.
*F01D 5/22* (2006.01)

(52) U.S. Cl.
CPC ..... *F01D 5/22* (2013.01)

(58) Field of Classification Search
CPC ..... F01D 5/22; F01D 5/225; F01D 5/16; F01D 5/20; F01D 5/24
USPC ..... 416/190, 191, 500
See application file for complete search history.

(56) References Cited

U.S. PATENT DOCUMENTS 3,990,813 A * 11/1976 Imai ..... F01D 5/22 416/196 R
4,260,331 A 4/1981 Goodwin
4,798,519 A 1/1989 Zipps et al.
5,067,876 A 11/1991 Moreman, III
5,174,720 A 12/1992 Gradl
5,267,834 A 12/1993 Dinh et al.
5,277,549 A 1/1994 Chen et al.
5,299,915 A 4/1994 Dinh et al.
5,393,200 A 2/1995 Dinh et al.
5,480,285 A 1/1996 Patel et al.
5,494,408 A 2/1996 Seeley et al.
5,531,569 A 7/1996 Seeley
5,695,323 A * 12/1997 Pfeifer et al. ..... 416/190
5,829,955 A 11/1998 Saito et al.
6,142,737 A 11/2000 Seeley et al.
6,435,833 B1 8/2002 Reluzco et al.
6,435,834 B1 8/2002 Reluzco et al.
6,499,959 B1 12/2002 Reluzco et al.
6,568,908 B2 5/2003 Namura et al.
6,575,700 B2 6/2003 Arai et al.
6,652,237 B2 11/2003 Yehle et al.
6,682,306 B2 1/2004 Murakami et al.
6,814,543 B2 11/2004 Barb et al.
6,846,160 B2 1/2005 Saito et al.
6,893,216 B2 5/2005 Snook et al.

(Continued)

OTHER PUBLICATIONS

Jones, Office Action Communication for U.S. Appl. No. 12/205,942 dated Aug. 2, 2011, 11 pages.

(Continued)

*Primary Examiner* — Christopher Verdier
*Assistant Examiner* — Aaron R Eastman
(74) *Attorney, Agent, or Firm* — Ernest G. Cusick; Hoffman Warnick LLC

(57) ABSTRACT

A rotating blade for use in a turbomachine is disclosed. In an embodiment, the rotating blade includes an airfoil portion, a root section affixed to a first end of the airfoil portion, and a tip section affixed to a second end of the airfoil portion, the second end being opposite the first end. A part span shroud is affixed to the airfoil portion between the tip section and the root section, wherein the part span shroud further comprises a hollow portion.

16 Claims, 7 Drawing Sheets

(56) References Cited

U.S. PATENT DOCUMENTS

| | | | | |
|---|---|---|---|---|
| 7,097,428 | B2 | 8/2006 | Barb et al. | |
| 7,195,455 | B2 | 3/2007 | Stonitsch et al. | |
| 2002/0057969 | A1* | 5/2002 | Namura et al. | 416/238 |
| 2003/0049131 | A1 | 3/2003 | Murakami et al. | |
| 2004/0126235 | A1 | 7/2004 | Barb et al. | |
| 2007/0292265 | A1 | 12/2007 | Burdgick et al. | |
| 2008/0089788 | A1* | 4/2008 | Loehle et al. | 416/191 |
| 2009/0202344 | A1* | 8/2009 | Bruce et al. | 415/198.1 |
| 2009/0214345 | A1 | 8/2009 | DeMania et al. | |
| 2010/0021306 | A1 | 1/2010 | Mujezinovic et al. | |
| 2010/0092295 | A1 | 4/2010 | Riaz et al. | |
| 2012/0027616 | A1* | 2/2012 | Merrill et al. | 416/241 B |
| 2013/0058788 | A1* | 3/2013 | Brandl et al. | 416/95 |

OTHER PUBLICATIONS

Jones, Notice of Allowance and Fee(s) Due for U.S. Appl. No. 12/205,942 dated Oct. 18, 2011, 13 pages.

Amir Mujezinovic, "Bigger Blades Cut Costs", Modern Power Systems, Feb. 2003, pp. 25, 27.

Michael Boss, "Steam Turbine Technology Heats Up", PEI Magazine, Apr. 2003, pp. 77, 79, 81.

* cited by examiner

Section A-A

BLADE HAVING A HOLLOW PART SPAN SHROUD

BACKGROUND OF THE INVENTION

The invention relates generally to a rotating blade for use in a turbomachine. More particularly, the invention relates to a rotating blade including a part span shroud having a hollow portion therein, the blade further including an optimized fillet size.

The fluid flow path of a turbomachine such as a steam or gas turbine is generally formed by a stationary casing and a rotor. In this configuration, a number of stationary vanes are attached to the casing in a circumferential array, extending inward into the flow path. Similarly, a number of rotating blades are attached to the rotor in a circumferential array and extend outward into the flow path. The stationary vanes and rotating blades are arranged in alternating rows so that a row of vanes and the immediate downstream row of blades form a stage. The vanes serve to direct the flow path so that it enters the downstream row of blades at the correct angle. Airfoils of the blades extract energy from the working fluid, thereby developing the power necessary to drive the rotor and the load attached thereto.

The blades of the turbomachine may be subject to vibration and axial torsion as they rotate at high speeds. To address these issues, blades typically include part span shrouds disposed on the airfoil portion at an intermediate distance between the tip and the root section of each blade. The part span shrouds are typically affixed to each of the pressure (concave) and suction (convex) sides side of each airfoil, such that the part span shrouds on adjacent blades matingly engage and frictionally slide along one another during rotation of the rotor. Part span shrouds having solid construction have greater weights and typically require larger fillets to ease structural stress between the part span shroud and the airfoil surface and to support the part span shroud on the airfoil. This tends to result in less aerodynamic blades, and therefore a decrease in flow rate and overall performance of the turbomachine.

BRIEF DESCRIPTION OF THE INVENTION

A first aspect of the disclosure provides a rotating blade for a turbomachine, the rotating blade comprising: an airfoil portion; a root section affixed to a first end of the airfoil portion; a tip section affixed to a second end of the airfoil portion, the second end being opposite the first end; and a part span shroud affixed to the airfoil portion between the root section and the tip section, wherein the part span shroud further comprises a hollow portion.

A second aspect of the disclosure provides a turbomachine comprising: a rotor rotatably mounted within a stator, the rotor including a shaft; and at least one rotor wheel mounted on the shaft, each of the at least one rotor wheels including a plurality of radially outwardly extending blades mounted thereto. Each blade includes: an airfoil portion; a root section affixed to a first end of the airfoil portion; a tip section affixed to a second end of the airfoil portion, the second end being opposite the first end; a part span shroud affixed to the airfoil portion between the tip section and the root section, wherein the part span shroud further comprises a hollow portion.

These and other aspects, advantages and salient features of the invention will become apparent from the following detailed description, which, when taken in conjunction with the annexed drawings, where like parts are designated by like reference characters throughout the drawings, disclose embodiments of the invention.

Figure 1:
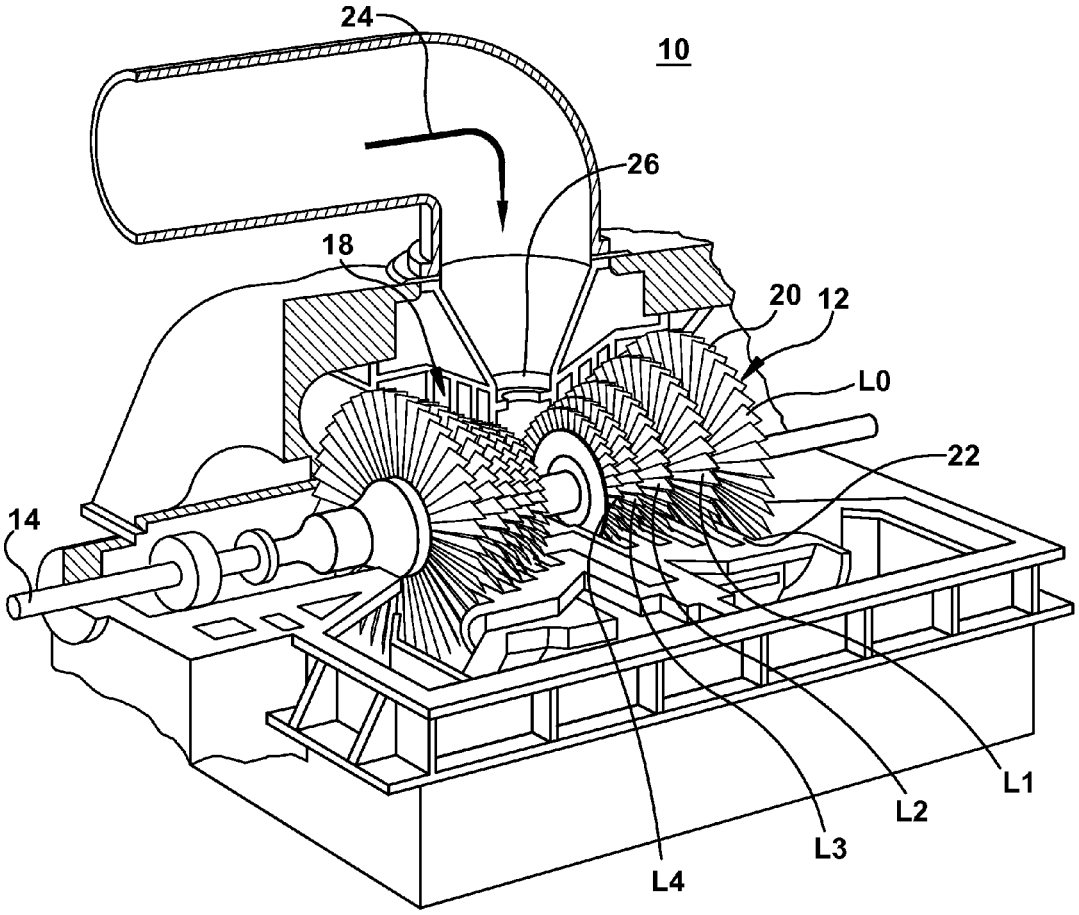
FIG. 1 shows a perspective partial cutaway illustration of a steam turbine according to an embodiment of the invention.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

At least one embodiment of the present invention is described below in reference to its application in connection with the operation of one of a gas or steam turbine engine. Although embodiments of the invention are illustrated relative to a gas and a steam turbine engine, it is understood that the teachings are equally applicable to other electric machines including, but not limited to, gas turbine engine compressors, and fans and turbines of aviation gas turbines. Further, at least one embodiment of the present invention is described below in reference to a nominal size and including a set of nominal dimensions. However, it should be apparent to those skilled in the art that the present invention is likewise applicable to any suitable turbine and/or compressor. Further, it should be apparent to those skilled in the art that the present invention is likewise applicable to various scales of the nominal size and/or nominal dimensions.

Figure 2:
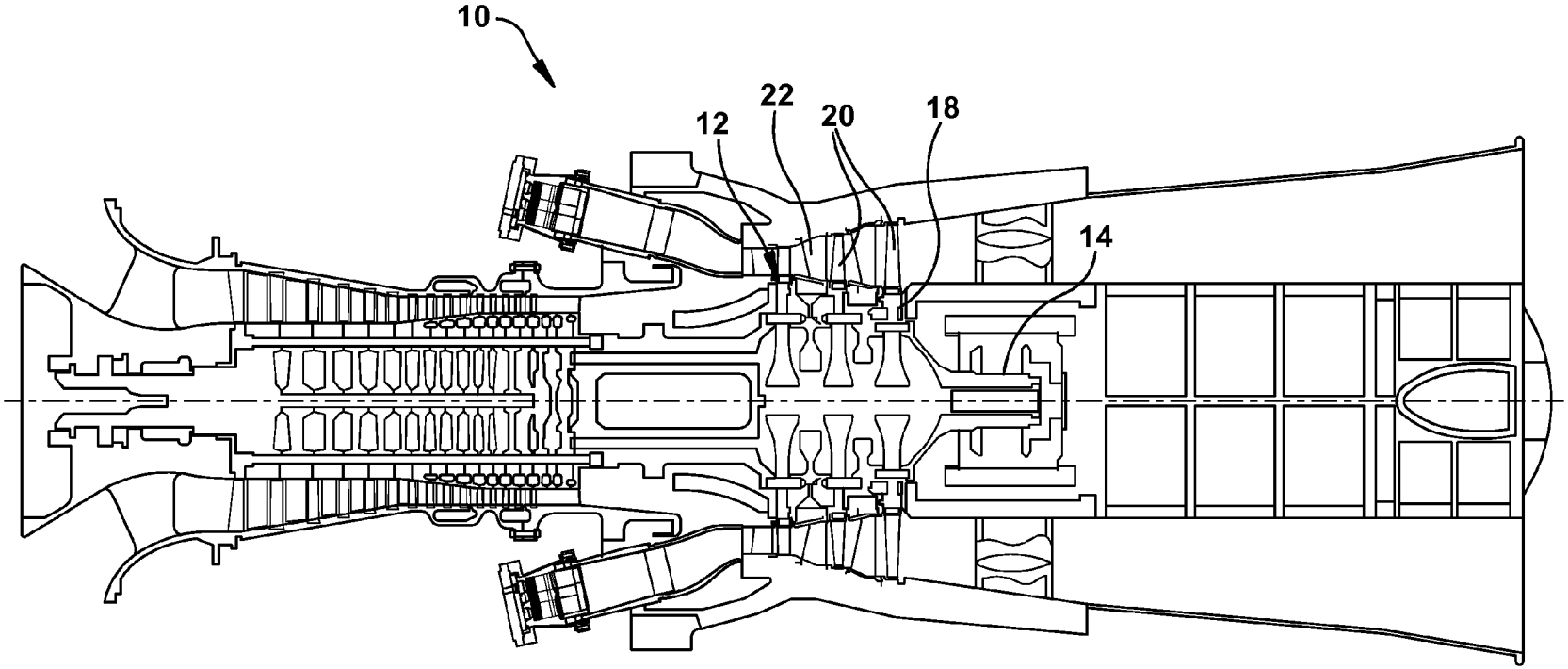
FIG. 2 shows a cross sectional illustration of a gas turbine according to an embodiment of the invention.

Referring to the drawings, FIGS. 1-2 illustrate examplary turbine 10 environments. FIG. 1 shows a perspective partial cut-away illustration of a steam turbine 10. The steam turbine 10 includes a rotor 12 that includes a shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extends circumferentially around shaft 14 and are axially positioned between adjacent rows of blades 20. Stationary vanes 22 cooperate with blades 20 to form a turbine stage and to define a portion of a steam flow path through turbine 10.

In operation, steam 24 enters an inlet 26 of turbine 10 and is channeled through stationary vanes 22. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine. Accordingly, a large steam turbine unit may actually include several turbines that are all co-axially coupled to the same shaft 14. Such a unit may, for example, include a high pressure turbine coupled to an intermediate-pressure turbine, which is coupled to a low pressure turbine.

In one embodiment of the present invention, shown in FIG. 1, turbine 10 comprise five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, more or fewer than five stages may be present.

With reference to FIG. 2, a cross sectional illustration of a gas turbine 10 is shown. The turbine 10 includes a rotor 12 that includes a shaft 14 and a plurality of axially spaced rotor wheels 18. In some embodiments, each rotor wheel 18 may be made of metal such as, for example, steel. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14 and are axially positioned between adjacent rows of blades 20.

During operation, air at atmospheric pressure is compressed by a compressor and delivered to a combustion stage. In the combustion stage, the air leaving the compressor is heated by adding fuel to the air and burning the resulting air/fuel mixture. The gas flow resulting from combustion of fuel in the combustion stage then expands through turbine 10, delivering some of its energy to drive turbine 10 and produce mechanical power. To produce driving torque, turbine 10 consists of one or more stages. Each stage includes a row of vanes 22 and a row of rotating blades 20 mounted on a rotor wheel 18. Vanes 22 direct incoming gas from the combustion stage onto blades 20. This drives rotation of the rotor wheels 18, and as a result, shaft 14, producing mechanical power.

Figure 3:
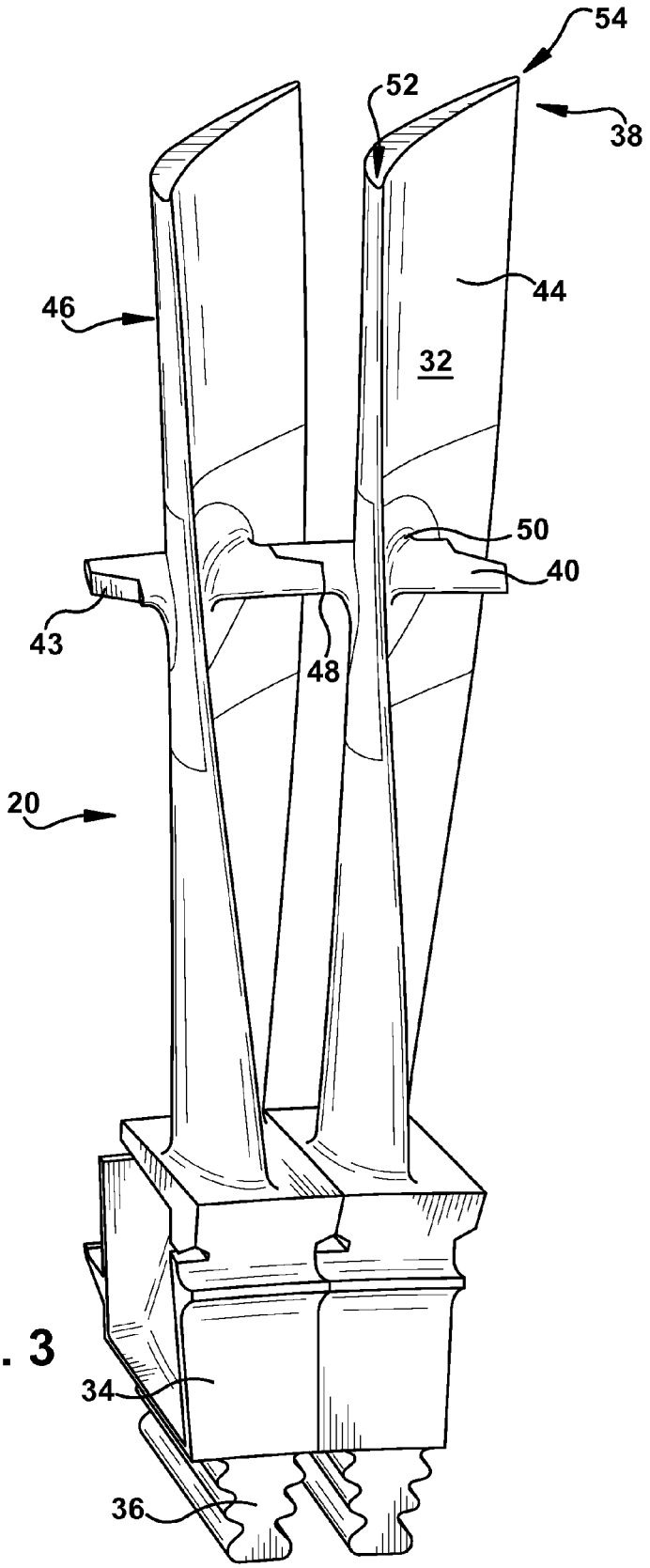
FIG. 3 shows a perspective illustration of two adjacent rotating blades according to an embodiment of the invention.

Turning to FIG. 3, blade 20 is shown in greater detail. Blade 20 includes an airfoil portion 32. A root section 34 is affixed to a first end of the airfoil portion 32. When assembled as in FIGS. 1-2, root section 34 is disposed at a radially inward end of airfoil portion 32. A blade attachment member 36 projects from the root section 34. In some embodiments, blade attachment member 36 may be a dovetail, but other blade attachment member shapes and configurations are well known in the art and are also contemplated. At a second, opposite end of airfoil portion 32 is a tip section 38. When assembled as shown in FIGS. 1-2, the second end of airfoil portion 32 at which tip section 38 is disposed is a radially outward end of blade 20.

Figure 5:
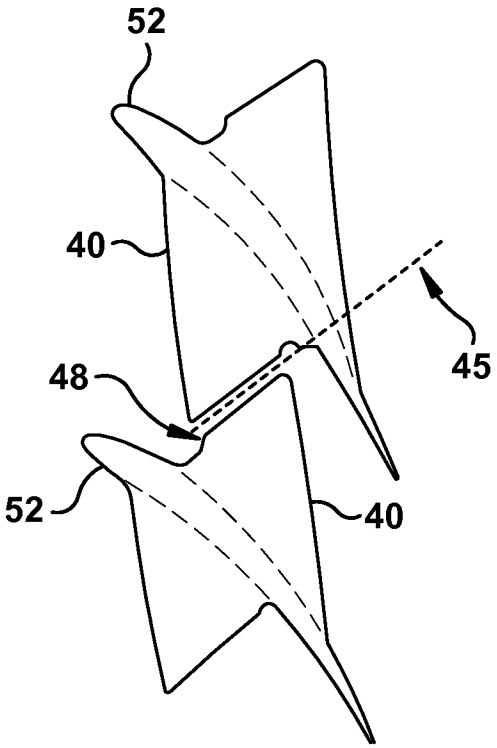
FIG. 5 shows a top view of a portion of two adjacent rotating blades including part span shrouds according to an embodiment of the invention.
Figure 4:
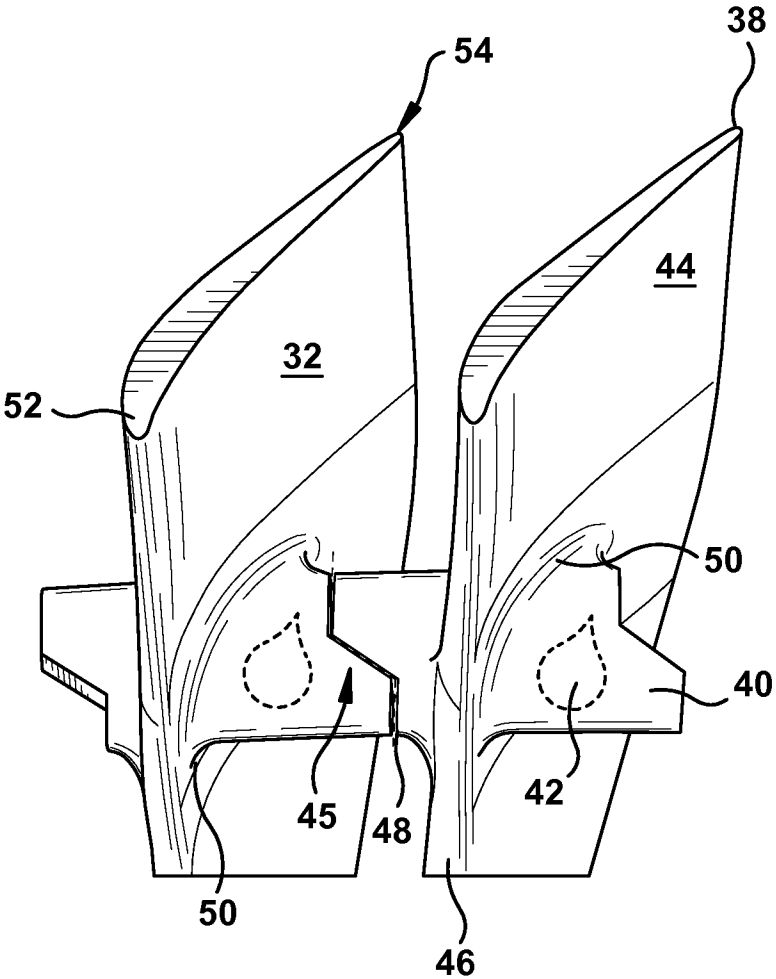
FIG. 4 shows an enlarged perspective illustration of a portion of two adjacent rotating blades including part span shrouds according to an embodiment of the invention.

As shown in FIGS. 3-4, a part span shroud 40 is affixed to an intermediate section of airfoil portion 32 between root section 34 and tip section 38. Part span shrouds 40 are located on both the pressure (concave) side 44 and the suction (convex) side 46 of blade 20. The interrelation of embodiments of adjacent part span shrouds 40 is shown in detail in FIGS. 4-5. During zero-speed conditions, a gap 48 exists between adjacent part span shrouds 40 which are affixed to airfoil portions 32 of neighboring blades 20 (FIG. 4). Gap 48 is closed as the turbine rotor wheel 18 (FIGS. 1-2) begins to rotate and approaches operating speed, and the blades untwist. As shown in FIG. 4, part span shrouds 40 may use a z-locking configuration, in which contact surfaces 43 (FIG. 3) of adjacent part span shrouds 40 contact one another along line 45 (FIG. 4) which may be substantially z-shaped. In other embodiments, as shown in FIG. 5, part span shrouds 40 may use a straight-angular configuration as is known in the art, in which part span shrouds contact one another along line 45. Further, with reference to FIGS. 16-17, some embodiments may include a cover 60 for use at tip section 38 (FIG. 3). Cover 60 may improve the stiffness and dampening characteristics of blade 20. A seal tooth 62 may function as a sealing means to limit the flow of working fluid past the outer portion of blade 20. Seal tooth 62 can be a single rib or formed of multiple ribs, a plurality of straight or angled teeth, or one or more teeth of different dimensions (e.g., a labyrinth type seal).

Figure 16:
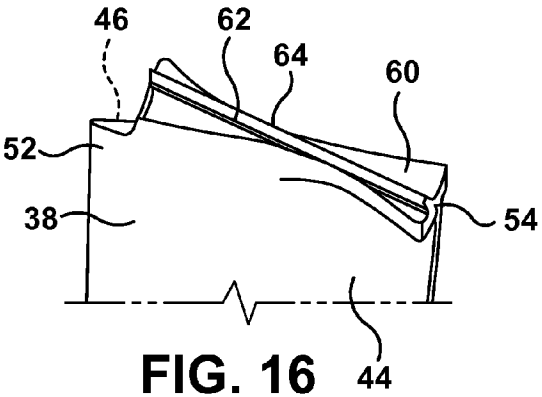

As shown in FIG. 16, cover 60 comprises a flat section that extends away from leading edge 52 at a predetermined distance therefrom to trailing edge 54. Cover 60 has a width that narrows substantially from the end located at the predetermined distance away from leading edge 52 to a location that is in a substantially central location 64 with respect to trailing edge 54 and leading edge 52. The width of cover 60 increases from central location 64 to trailing edge 54. The width of cover 60 at the end located at the predetermined distance away from leading edge 52 and the width of cover 60 at trailing edge 54 are substantially similar. FIG. 16 further shows that seal tooth 62 projects upward from cover 60, wherein seal tooth 62 extends from the end located at the predetermined distance away from leading edge 52 through substantially central location 64 to trailing edge 54. FIG. 16 also shows that cover 60 extends over suction side 46 at the end located at the predetermined distance away from leading edge 52 to about central location 64 and cover 60 extends over pressure side 44 from central location 64 to trailing edge 54.

Figure 17:
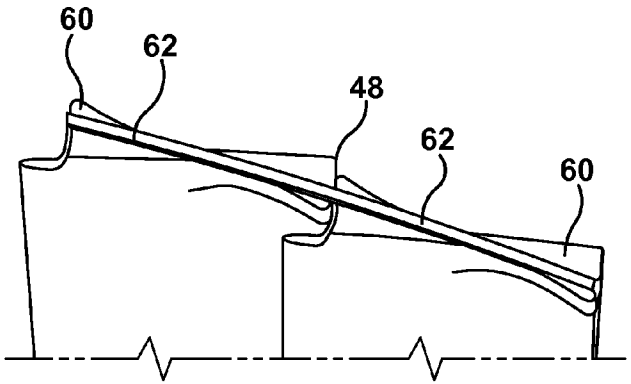
FIGS. 16-17 shows a perspective view of a cover, and the interrelation of two such covers, respectively, in accordance with an embodiment of the invention.

FIG. 17 is a perspective illustration showing the interrelation of adjacent covers 60 according to one embodiment of the present invention. In particular, FIG. 17 illustrates an initially assembled view of covers 60. Covers 60 are designed to have a gap 48 between adjacent covers 60 during initial assembly and/or at zero speed conditions, as described above. As can be seen, seal teeth 62 are also slightly misaligned in the zero rotation condition. As turbine rotor wheel 18 (shown in FIGS. 1-2) is rotated, blades 20 begin to untwist as described above. As the revolutions per minute (RPM) of blades 20 approach the operating level, the blades untwist due to centrifugal force, the gaps 48 close and the seal teeth 62 becomes aligned with each other so that there is nominal gap with adjacent covers and blades 20 form a single continuously coupled structure in a similar fashion to the embodiments described above.

Referring back to FIGS. 3-4, part span shrouds 40 may be aerodynamically shaped to reduce windage losses and improve overall efficiency. The blade stiffness and damping characteristics are also improved as part span shrouds 40 contact each other during blade 20 untwist. As the blades 20 untwist, part span shrouds 40 contact their respective neighboring part span shrouds 40. The plurality of blades 20 behave as a single, continuously coupled structure that exhibits improved stiffness and dampening characteristics when compared to a discrete and uncoupled design. Blades 20 also exhibit reduced vibratory stresses.

Figure 6:
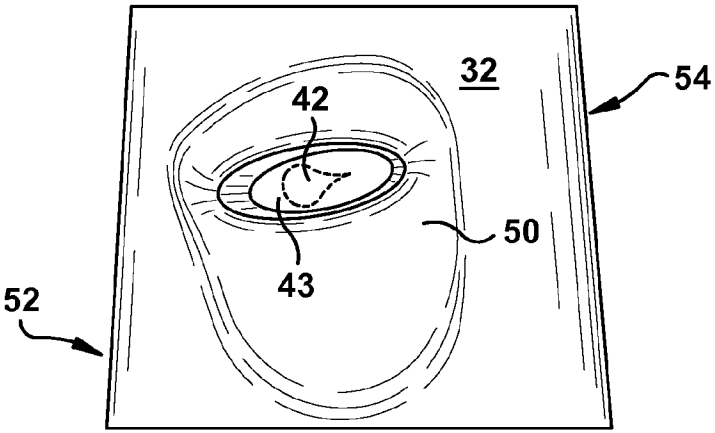
FIG. 6 shows a side view of a part span shroud according to an embodiment of the invention.

In various embodiments, part span shrouds 40 may take a variety of shapes. As shown in FIGS. 3-4, part span shrouds 40 may be substantially fin-shaped, and project outward from each of pressure side 44 and suction side 46 of airfoil portion 32. FIG. 6 depicts a winglet shaped part span shroud embodiment, although variations in the specific shape and dimensions are possible and are also considered part of the disclosure. Part span shroud 40 may be airfoil-shaped, as in FIG. 7, or elliptical-shaped, as in FIG. 8.

Figure 9:
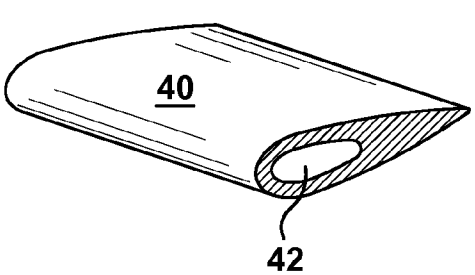
FIG. 9 shows a perspective partial cutaway illustration of a part span shroud according to an embodiment of the invention.
Figure 10:
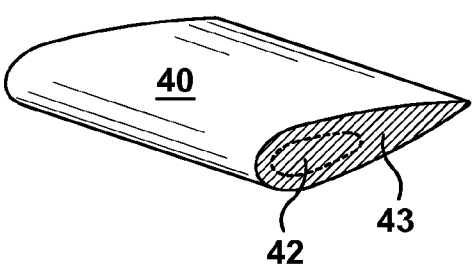
FIG. 10 shows a perspective view of a part span shroud according to an embodiment of the invention.
Figure 11:
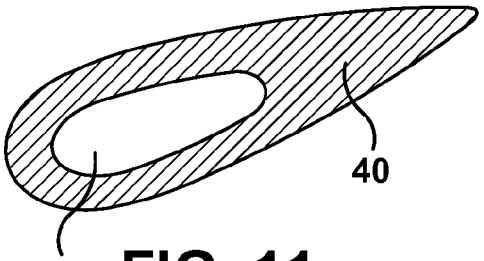
FIG. 11 shows a cross section of a part span shroud according to an embodiment of the invention.
Figure 12:
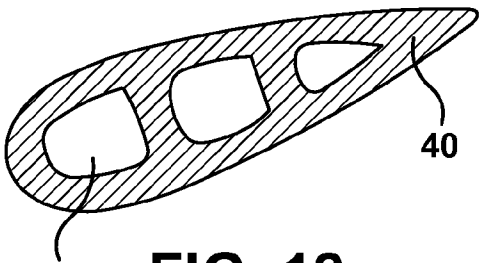
FIG. 12 shows a cross section of a part span shroud according to an embodiment of the invention.
Figure 13:
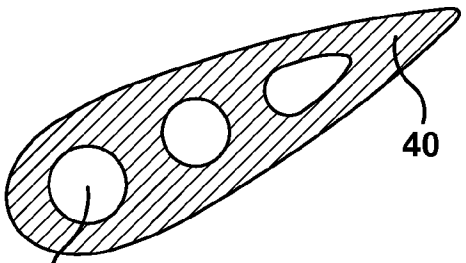
FIG. 13 shows a cross section of a part span shroud according to an embodiment of the invention.

As further shown in FIG. 9, part span shroud 40 may include a hollow portion 42, shown in phantom in FIGS. 4, 6, and 10. In various embodiments, hollow portion 42 may include any of a number of possible cavity shapes as shown in FIGS. 11-13. As shown, hollow portion 42 may consist of one cavity (FIG. 11) or more than one cavity (FIGS. 12-13), and which may be shaped substantially elliptically, or roundly, or which may follow a exterior curve of part span shroud 40. The configurations depicted in FIGS. 11-13 are not intended to be limiting, however; they are merely examples of possible configurations. Aspects of these configurations may be combined with one another. Other embodiments are also possible, and are considered part of the disclosure.

Figure 7:
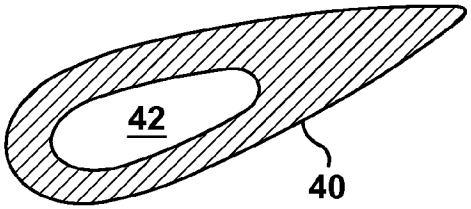
FIG. 7 shows a cross section of a part span shroud according to an embodiment of the invention.
Figure 8:
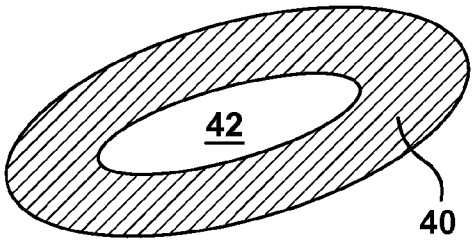
FIG. 8 shows a cross section of a part span shroud according to an embodiment of the invention.

As shown in FIGS. 7 and 9-11, in some embodiments, hollow portion 42 may be disposed on an interior of a leading edge portion of part span shroud 40, while in other embodiments, hollow portion 42 may be substantially centered in part span shroud 40 (FIG. 8). Part span shroud 40 may further include a contact surface 43 (FIG. 10) over hollow portion 42, which closes off or encloses hollow portion 42. In some embodiments, contact surface 43 may comprise a brazed surface or a welded surface, and may be covered.

By positioning hollow portion 42 on the leading edge 52 side of part span shroud 40, as shown in FIG. 7, part span shroud 40 can be positioned on airfoil portion 32 such that it is nearer to leading edge 52 than to trailing edge 54 without creating any center of gravity imbalance. In particular, part span shroud 40 may be located on airfoil portion 32 such that the center of gravity of part span shroud 40 is laterally aligned with the center of gravity of blade 20, and further, may maintain this alignment while having part span shroud 40 disposed on airfoil portion 32 nearer to a leading edge 52 than to trailing edge 54. This positioning results in increased efficiency and decreased performance penalty.

Figure 15:
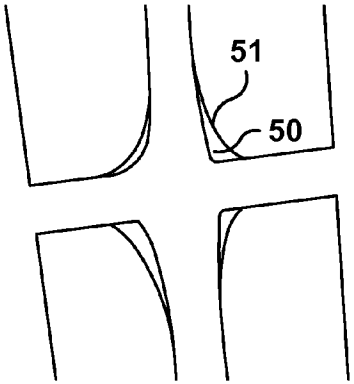
FIG. 15 shows a cross sectional schematic of a fillet along line A-A in FIG. 14, according to an embodiment of the invention.
Figure 14:
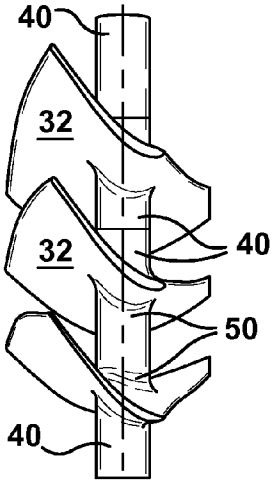
FIG. 14 shows a perspective view of the interrelation of part span shrouds affixed to adjacent blades according to an embodiment of the invention.

Part span shroud 40 may further include fillet 50 (FIGS. 3-4, 6, 15-15) for easing an exterior corner formed by the part span shroud 40 and the airfoil portion 32 and supporting part span shroud 40 on airfoil portion 32. The size and shape of fillet 50 may be optimized based on the particular part span shroud 40 in a particular embodiment. In particular, part span shroud 40 may be optimized based on the shape, dimension, and weight of a particular part span shroud 40, including hollow portion 42. Specifically, as shown in FIGS. 14-15, embodiments in which part span shroud 40 includes hollow portion 42, may include a smaller fillet 50, i.e., it may ease the exterior corner between part span shroud 40 and airfoil portion 32 to a lesser degree, than a fillet 51 included on a part span shroud 40 that is solid and therefore weighs more and requires more support. The smaller fillet 50 is more aerodynamic, and therefore leads to increased efficiency, relative to the larger fillet 51.

The blade 20 and part span shroud 40 described above may be used in a variety of turbomachine environments. For example, blade 20 having part span shroud 40 may operate in any of a front stage of a compressor, a latter stage in a gas turbine, a low pressure section blade in a steam turbine, a front stage of compressor, and a latter stage of turbine for aviation gas turbine.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotating blade for a turbomachine, the rotating blade comprising:

an airfoil portion;

a root section affixed to a first end of the airfoil portion;

a tip section affixed to a second end of the airfoil portion, the second end being opposite the first end; and a part span shroud affixed to the airfoil portion between the root section and the tip section, wherein the part span shroud further comprises a hollow portion extending within the part span shroud and terminating at one of a suction surface of the airfoil portion or a pressure surface of the airfoil portion, and wherein the part span shroud further comprises one of a brazed contact surface or a welded contact surface to enclose the hollow portion within the part span shroud.

2. The rotating blade of claim 1, wherein the hollow portion is disposed in a position that is closer to a leading edge of the part span shroud than a trailing edge of the part span shroud.

3. The rotating blade of claim 1, wherein the part span shroud further comprises a fillet for easing an exterior corner formed by the part span shroud and the airfoil portion.

4. The rotating blade of claim 1, wherein a center of gravity of the part span shroud is laterally aligned with a center of gravity of the blade.

5. The rotating blade of claim 4, wherein the part span shroud is disposed on the airfoil portion nearer to a leading edge than a trailing edge.

6. The rotating blade of claim 1, wherein the rotating blade operates as one of:

a front stage blade in a compressor, a latter stage blade in a gas turbine, or a low pressure section blade in a steam turbine.

7. The rotating blade of claim 1, further comprising a blade attachment member projecting from the root section.

8. The rotating blade of claim 1, wherein the hollow portion includes a plurality of cavities within the part span shroud.

9. A turbomachine comprising:

a rotor rotatably mounted within a stator, the rotor including:

a shaft; and at least one rotor wheel mounted on the shaft, each of the at least one rotor wheels including a plurality of radially outwardly extending blades mounted thereto, wherein each blade includes:

an airfoil portion;

a root section affixed to a first end of the airfoil portion;

a tip section affixed to a second end of the airfoil portion, the second end being opposite the first end; and a part span shroud affixed to the airfoil portion between the root section and the tip section, wherein the part span shroud further comprises a hollow portion extending within the part span shroud and terminating at one of a suction surface of the airfoil portion or a pressure surface of the airfoil portion, and wherein the part span shroud further comprises one of a brazed contact surface or a welded contact surface to enclose the hollow portion within the part span shroud.

10. The turbomachine of claim 9, wherein the hollow portion is disposed in a position that is closer to a leading edge of the part span shroud than a trailing edge of the part span shroud.

11. The turbomachine of claim 9, wherein the part span shroud further comprises a fillet for easing an exterior corner formed by the part span shroud and the airfoil portion.

12. The turbomachine of claim 9, wherein a center of gravity of the part span shroud is laterally aligned with a center of gravity of the blade.

13. The turbomachine of claim 12, wherein the part span shroud is disposed on the airfoil portion nearer to a leading edge than a trailing edge.

14. The turbomachine of claim 9, wherein the turbomachine comprises one of: a gas turbine, a steam turbine, or a compressor.

15. The turbomachine of claim 9, further comprising a blade attachment member projecting from the root section.

16. The turbomachine of claim 9, wherein the hollow portion includes a plurality of cavities within the part span shroud.

* * * * *